US007257980B2

(12) United States Patent
Leiponen

(10) Patent No.: US 7,257,980 B2
(45) Date of Patent: Aug. 21, 2007

(54) METHOD AND EQUIPMENT FOR PERFORMING CONTINUOUS EXTRUSION

(76) Inventor: Matti Leiponen, Jaalaranta 6 C 48, FI-00180 Helsinki (FI)

( * ) Notice: Subject to any disclaimer, the term of this patent is extended or adjusted under 35 U.S.C. 154(b) by 0 days.

(21) Appl. No.: 10/563,542

(22) PCT Filed: Jun. 14, 2004

(86) PCT No.: PCT/FI2004/000365

§ 371 (c)(1),
(2), (4) Date: Dec. 22, 2005

(87) PCT Pub. No.: WO2005/000493

PCT Pub. Date: Jan. 6, 2005

(65) Prior Publication Data

US 2006/0156781 A1 Jul. 20, 2006

(30) Foreign Application Priority Data

Jun. 27, 2003 (FI) ..... 20030956

(51) Int. Cl.
*B21C 23/00* (2006.01)

(52) U.S. Cl. ..... 72/262; 72/38

(58) Field of Classification Search ..... 72/38, 72/262, 271; 425/405.1; 264/85
See application file for complete search history.

(56) References Cited

U.S. PATENT DOCUMENTS 3,834,199 A * 9/1974 Rouyer et al. ..... 72/38
4,313,673 A 2/1982 Wartinger et al.
4,650,408 A * 3/1987 Anderson et al. ..... 425/79
5,133,126 A 7/1992 Matsuoka
5,782,120 A 7/1998 Wright
6,637,249 B1 * 10/2003 Heikkila ..... 72/262

FOREIGN PATENT DOCUMENTS

| | | | |
|---|---|---|---|
| GB | 2241660 A | | 9/1991 |
| JP | 61-195969 | * | 8/1986 |
| JP | 6-226335 | * | 8/1994 |
| JP | 09-323104 A | | 12/1997 |
| JP | 10-166035 A | | 6/1998 |
| WO | WO90/14176 A1 | | 11/1990 |

OTHER PUBLICATIONS

International Search Report for PCT/FI2004/000365, dated Oct. 28, 2004.

* cited by examiner

*Primary Examiner*—Ed Tolan
(74) *Attorney, Agent, or Firm*—Morgan & Finnegan, LLP

(57) ABSTRACT

The invention relates to a method for performing continuous extrusion of a metallic material, such as copper, so that the material to be extruded (1) is fed in the extrusion member (4) by means of a feed member (3) provided with a groove on its peripheral wall (2) and by an abutment (5) arranged in said groove, so that the groove (8) is protected against oxidation by arranging for at least part of the peripheral wall (2) of the feed member (3) a gas-protecting member (7). The invention also relates to said equipment.

18 Claims, 2 Drawing Sheets

METHOD AND EQUIPMENT FOR PERFORMING CONTINUOUS EXTRUSION

Figure 1:
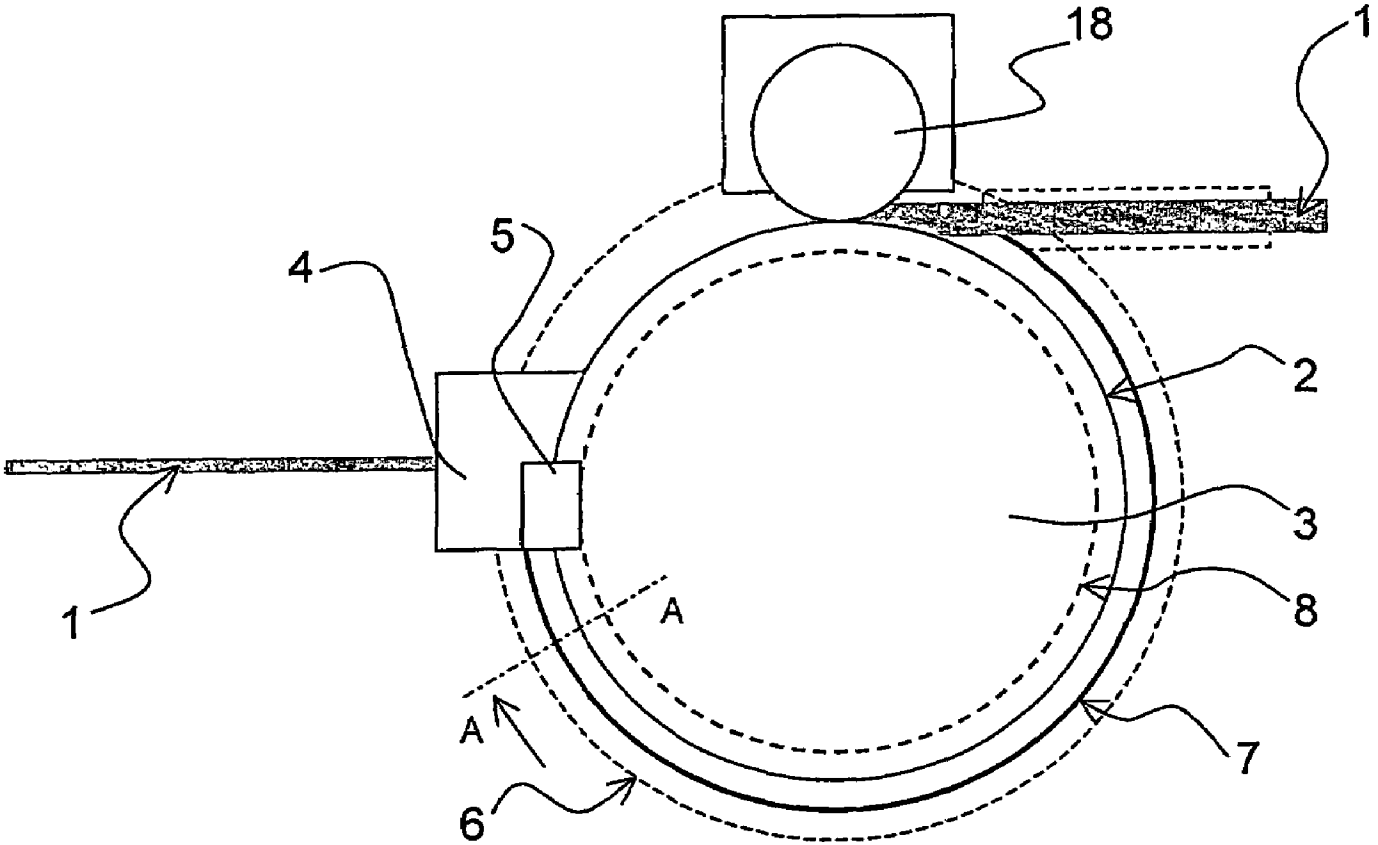

This application claims the benefit of International Application No. PCT/FI2004/000365 filed on Jun. 14, 2004, 35 U.S.C. §371, entitled, "METHOD AND EQUIPMENT FOR PERFORMING CONTINUOUS EXTRUSION" which claims the benefit of Finnish Patent Application No. 20030956, filed on Jun. 27, 2003.

The invention relates to a method and equipment according to the independent claims for performing continuous extrusion of a metallic material, such as copper.

In continuous extrusion, the material to be extruded is conducted in a groove made on the outer circumference of a wheel-like element. As the element rotates around its axis, the material to be extruded gets into contact with an abutment that essentially fills the groove, so that the motion of the material to be extruded is changed with respect to the wheel-like member. Thus the material is arranged to be extruded in the proceeding direction of the material before the abutment, through a passageway arranged in the extrusion member. The method utilizes friction and thermal energy created in the working process. By means of the method, it is possible to advantageously extrude essentially long objects that are different in their transversal surfaces.

In the course of the process, it is possible that on the surface of objects made of copper or copper alloys, there are created oxide layers that are harmful in the further processing of said objects. In traditional extrusion, in the vicinity of the surface there may be created oxide layers that result in the tearing of the structure in hydrogen annealing. When welding thin strips into tubes, oxides may create leakages in the welding area. Surfaces must be cleaned several times of the oxide layers accumulated thereon. Oxide layers are difficult to detect or measure on the surface of copper, and they are not necessarily distinguished without special equipment. The removal of thick oxide layers from the surface of copper is fairly simple, but the removal of the last molecular layers has turned out to be more difficult.

In traditional continuous extrusion, oxides are removed as so-called extrusion scrap, the processing and recirculation of which bring forth disadvantageous extra expenses. In addition, the creation of hot extrusion scrap results in an intensive wearing of the extrusion tools. Even if oxides were removed from the surface of the feed material before the continuous extrusion, oxidation could also take place during the extrusion of the material. When manufacturing a copper product by extrusion, a completely oxygen-free process would ensure a better quality for the product. It is well-known that in order to solve said problem, the extrusion equipment is protected by surrounding the equipment by an atmosphere that prevents the passage of oxides and other impurities in the extruded product. However, it has been found out that even slight oxygen-contents in the protecting gas may cause oxidation that is harmful for the product. Also the groove lining may be oxidized owing to a too high oxygen level in the gas protection, which may cause occasional flaws in the products.

In the patent publication U.S. Pat. No. 5,782,120, there is described an equipment for continuous extrusion, where the feed member, i.e. a wheel, included in the extrusion equipment is protected by a hood containing non-oxidizing gas.

The object of the present invention is to introduce a novel solution for performing continuous extrusion of a material. A particular object of the invention is to introduce a solution where the product created in continuous extrusion is protected against oxidation.

The invention is characterized by what is set forth in the characterizing parts of the independent claims. Other preferred embodiments of the invention are characterized by what is set forth in the other claims.

Remarkable advantages are achieved by the arrangement according to the invention. The invention relates to a method for performing continuous extrusion of a metallic material, such as copper, so that the material to be extruded is fed in the extrusion member by means of a feed member provided with a groove on its peripheral wall and an abutment arranged in the groove; the groove is protected against oxidation by providing at least part of the peripheral wall of the feed member with a gas-protecting member. The gas-protecting member according to the invention advantageously enables the feeding of non-oxidizing gases in the groove area, which in turn prevents the passage of oxygen and oxides in the extrusion product. The gas-protecting member according to the invention is arranged at least on that part of the peripheral wall that does not contain material to be extruded, and the gas-protecting member covers at least part of the surface of the peripheral wall of the feed member in the width direction thereof. Thus the oxidation of the groove is particularly prevented at the hottest spot of the feed member, on the peripheral wall of the feed member after the abutment, where the material to be extruded is removed from the groove. The hot surface of the groove lining is a remarkable source of oxides and consequently enhances the oxidation of the product. According to the invention, the gas-protecting member is arranged on the peripheral wall of the feed member, so that it covers at least the groove, in which case the space left between the gas-protecting member and the feed member is arranged to be oxygen-free. In the space left between the gas-protecting member and the feed member, there is fed non-oxidizing gas, such as hydrogen or hydrogen and nitrogen, by means of the gas-protecting member. The gas can be preheated up to for example 400-800 degrees. According to a preferred embodiment of the invention, oxygen is removed from the gas to be fed in prior to feeding it in the space left between the gas-protecting member and the feed member. Oxygen can be removed by using prior art methods, such as filtering. Thus even extremely low oxygen contents can be eliminated. Hydrogen can advantageously be used for removing oxygen from neutral gases. Nitrogen is fed in for circulation-technical reasons. According to the invention, the extrusion process is surrounded by an inert gas protection, and the effects of the residual oxygen contained by said gas protection are eliminated by applying the solution of the invention. In the space left between the gas-protecting member and the feed member, i.e. in the vicinity of the groove, there prevails a higher pressure than in the inert gas protection, and the gas circulation is thus directed away from the groove.

The invention also relates to an equipment for performing continuous extrusion of metallic material, such as copper, so that the material to be extruded is fed in the extrusion member by means of a feed member provided with a groove on its peripheral wall and an abutment arranged in the groove, so that at least part of the peripheral wall of the feed member is provided with a gas-protecting member for protecting the groove against oxidation.

According to a preferred embodiment of the invention, the gas-protecting member comprises at least one protecting member provided with at least one gas channel for feeding gas into the space left between the gas-protecting member and the feed member. Thus the gas can be conducted, through the gas-protecting member, in a desired spot in the groove. According to an embodiment of the invention, the gas-protecting member comprises an inner protecting member and at least one outer protecting member. According to the invention, the gas fed in from the inner protecting member has a higher pressure than the gas fed in from the outer protecting member. There is thus created a circulation away from the groove through the gap left between the protection member and the feed member. On both sides of the groove, on the peripheral wall of the feed member, there is provided at least one lining element for sealing the gap between the gas-protecting member and the feed member. The lining element is made of the same material as the material to be extruded. Thus the residual oxygen from the gas protection surrounding the whole extrusion equipment is advantageously prevented from accessing the vicinity of the groove.

The solution according to the invention enables the creation of an oxygen-free space in the groove vicinity, which enhances the manufacturing of a flawless extrusion product. Consequently, the drawbacks caused by the processing and recirculation of extrusion scrap are avoided, because the creation of extrusion scrap is prevented.

The invention is described in more detail below with reference to the appended drawings.

FIG. 1 An equipment according to the invention

Figure 2:
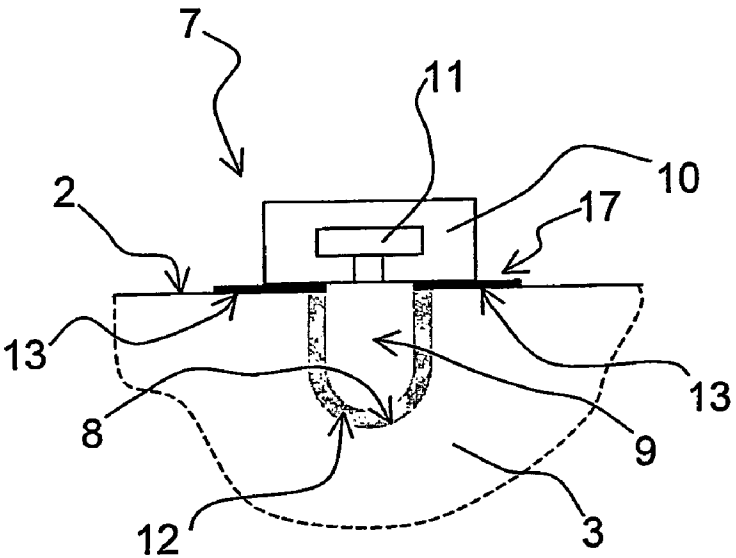

FIG. 2 An equipment according to the invention

Figure 3:
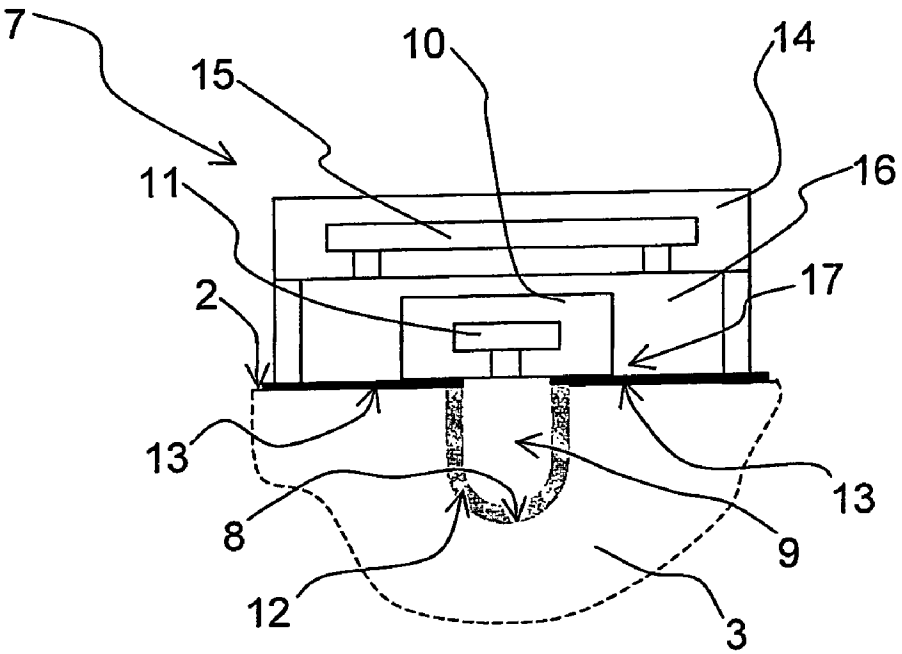

FIG. 3 An equipment according to the invention

FIG. 1 illustrates how, according to the invention, the material to be extruded 1, such as copper wire, is fed in the groove 8 located on the peripheral wall 2 of the feed member 3 by means of a pressure roller 18. The feed member 3 rotates around its axis, and the material to be extruded moves along the groove to the extrusion member 4 to be extruded. In connection with the extrusion, the temperature of the material to be extruded rises owing to the friction forces up to the temperature range of 550-750 degrees. In order to direct the material to be extruded to the extrusion member 4, the groove of the feed member is provided with an abutment 5 that extends over part of the length of the wheel groove. In the extrusion member 4, there is made a passageway of a desired shape, and the extrusion product is conducted out of the feed member 3 through said passageway. The extrusion process is throughout protected by a protective gas 6 against external room air. In the drawing, there is distinguished the gas-protecting member 7 arranged on part of the peripheral wall.

FIGS. 2 and 3 show how the gas-protecting member 7 according to the invention is arranged in the vicinity of the groove 8. FIGS. 2 and 3 are cross-sectional views of FIG. 1, seen along the line A-A. According to the invention, for at least part of the peripheral wall 2 of the feed member, there is arranged a gas-protecting member 7 in order to protect the groove against oxidation. According to the example of the invention, the gas-protecting member is arranged on that part of the peripheral wall 2 that does not contain material to be extruded. By means of the gas-protecting member 7, the vicinity of the groove 8 of the feed member 3 is set in an oxygen-free atmosphere, which enhances the creation of a flawless and high-quality extrusion product. The gas-protecting member 7 is made of some wear-resistant material, such as steel, and in shape, it may conform for example to the peripheral wall 2 of the feed member 3. The gas-protecting member covers at least part of the surface of the peripheral wall 2 in the width direction, and at least it covers the groove 8. According to the invention, the space 9 left between the gas-protecting member and the feed member is arranged to be oxygen-free by feeding in a desired amount of non-oxidizing gas. According to the invention, in the space 9 there is fed a gas mixture, heated up to the temperature of 600 degrees and containing hydrogen and nitrogen. The non-oxidizing gas can be removed through a specially arranged removal route.

The gas-protecting member 7 according to the example, illustrated in FIG. 2, includes a protecting member 10 provided with at least one gas channel 11, through which gas can be fed into the space 9 left between the feed member 3 and the gas-protecting member. When necessary, the gas channel can extend along the whole length of the gas-protecting member 7, or only along part of its length. Gas can be fed in at desired spots in the groove 9. The groove is provided with a lining 12 that protects the groove from wearing. Advantageously the lining is made of the same material as the material to be extruded, such as copper. In between the gas-protecting member and the feed member, on both sides of the groove, there are arranged lining elements 13 in order to seal the gap 17 between the gas-protecting member and the feed member.

FIG. 3 illustrates an embodiment of the invention, according to which the gas-protecting member 7 comprises an inner protecting member 10 and at least one outer protecting member 14. The outer protecting member includes at least one gas channel 15, through which non-oxidizing gas can be fed. The gas fed in through the inner protecting member 10 has a higher pressure than the gas fed in through the outer protecting member 14. Thus the gas space 16 left between the outer protecting member 14 and the inner protecting member 10 has a lower pressure than the space 9 left between the inner protecting member and the feed member. Consequently, the gas is made to flow in the desired direction, away from the groove. In addition, on both sides of the groove, on the peripheral wall 2 of the feed member 3, there are arranged lining elements 13, essentially so that they seal the gap 17 left between the gas-protecting member and the feed member, however so that gas can flow out of the groove 8.

For a man skilled in the art, it is obvious that the various preferred embodiments of the invention are not restricted to the examples described above, but may vary within the scope of the appended claims.

The invention claimed is:

1. A method for performing continuous extrusion of a metallic material, comprising feeding a metallic material into a groove located on a peripheral wall of a feed member, wherein the groove has an abutment arranged in said groove, protecting the groove against oxidation by a gas-protecting member for at least part of the peripheral wall of the feed member, wherein pressure in a space left between the gas-protecting member and the feed member is higher than the pressure in the surrounding atmosphere, and moving the metallic material along the groove into an extrusion member, wherein the gas-protecting member comprises at least one protecting member provided with at least one gas channel for feeding gas into the space left between the gas-protecting member and the feed member.

2. The method according to claim 1, wherein the gas-protecting member is arranged at least in a part of the peripheral wall that does not contain material to be extruded.

3. The method according to claim 1, wherein the gas-protecting member covers at least part of the surface of the peripheral wall of the feed member in the direction of the width thereof.

4. The method according to claim 1, wherein the gas-protecting member covers at least the groove.

5. The method according to claim 1, comprising feeding non-oxidizing gas through the gas-protecting member into the space left between the gas-protecting member and the feed member.

6. The method according to claim 5, comprising feeding hydrogen into the space left between the gas-protecting member and the feed member.

7. The method according to claim 5, comprising feeding hydrogen and nitrogen into the space left between the gas-protecting member and the feed member.

8. The method according to claim 5, comprising preheating the non-oxidizing gas up to 400-800 degrees.

9. The method according to claim 5, comprising removing oxygen from the non-oxidizing gas by filtration before feeding the gas into the space left between the gas-protecting member and the feed member.

10. The method according to claim 1, comprising protecting the extrusion method with an inert gas.

11. The method according to claim 10, wherein the pressure in the space left between the gas-protecting member and the feed member is higher than the pressure in the inert gas.

12. The method according to claim 1, wherein the metallic material is copper.

13. Equipment for performing continuous extrusion of a metallic material, comprising a groove located on a peripheral wall of a feed member; an abutment arranged in said groove; and for at least part of the peripheral wall of the feed member, a gas-protecting member, wherein pressure in a space left between the gas-protecting member and the feed member is higher than the pressure in the surrounding atmosphere, wherein the gas-protecting member comprises at least one protecting member provided with at least one gas channel for feeding gas into the space left between the gas-protecting member and the feed member.

14. The equipment according to claim 1, wherein the gas-protecting member comprises an inner protecting member and at least one outer protecting member.

15. The equipment according to claim 14, wherein the gas fed through the inner protecting member has a higher pressure than the gas fed in through the outer protecting member.

16. The equipment according to claim 13, comprising at least one lining element on both sides of the groove, on the peripheral wall of the feed member in order to seal a gap left between the gas-protecting member and the feed member.

17. The equipment according to claim 16, wherein the lining element is made of the same material as the metallic material to be extruded.

18. The equipment according to claim 13, wherein the metallic material is copper.

* * * * *